US009800976B2

(12) United States Patent
Honda et al.

(10) Patent No.: US 9,800,976 B2
(45) Date of Patent: Oct. 24, 2017

(54) ELECTROACOUSTIC TRANSDUCER

(71) Applicant: Kabushiki Kaisha Audio-Technica, Tokyo (JP)

(72) Inventors: Yoji Honda, Tokyo (JP); Kenzo Tsuihiji, Tokyo (JP); Koichiro Tanoue, Tokyo (JP); Kenji Arai, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 28 days.

(21) Appl. No.: 14/935,793

(22) Filed: Nov. 9, 2015

(65) Prior Publication Data

US 2016/0142812 A1 May 19, 2016

(30) Foreign Application Priority Data

Nov. 18, 2014 (JP) ..... 2014-233917

(51) Int. Cl.
*H04R 25/00* (2006.01)
*H04R 5/033* (2006.01)
*H04R 1/34* (2006.01)

(52) U.S. Cl.
CPC ..... *H04R 5/033* (2013.01); *H04R 1/345* (2013.01)

(58) Field of Classification Search
CPC .... H04K 2203/12; H04K 3/2217; G10K 1/16; G10K 1/161
USPC ..... 381/433, 395, 345, 346, 353, 370, 371, 381/372; 181/175, 183, 189, 179, 191, 181/197, 206
See application file for complete search history.

(56) References Cited

U.S. PATENT DOCUMENTS

| | | | | |
|---|---|---|---|---|
| 8,605,932 | B2 * | 12/2013 | Semcken | H04R 1/1058 381/332 |
| 2006/0104471 | A1 * | 5/2006 | Tsunoda | H04R 1/1041 381/374 |
| 2009/0268935 | A1 * | 10/2009 | Dillinger | H04R 1/1075 381/371 |
| 2011/0002475 | A1 * | 1/2011 | Kimura | H04R 1/1008 381/71.6 |
| 2014/0233746 | A1 * | 8/2014 | Tanaka | H04R 1/1016 381/66 |
| 2014/0233749 | A1 * | 8/2014 | Shimizu | H04R 1/1083 381/71.6 |
| 2015/0125025 | A1 * | 5/2015 | Button | H04R 1/00 381/401 |

FOREIGN PATENT DOCUMENTS

JP 2011-87993 5/2011

* cited by examiner

*Primary Examiner* — Md S Elahee
*Assistant Examiner* — Julie X Dang
(74) *Attorney, Agent, or Firm* — Whitham, Curtis & Cook, P.C.

(57) ABSTRACT

An electroacoustic transducer includes a driver, a diaphragm 13 driven to vibrate by the driver and emitting sound, a baffle 21 holding the diaphragm 13, first apertures 25 extending from the front surface to the rear surface of the baffle 21, and a first acoustic resistor 22 disposed on the front surface of the baffle so as to cover the first apertures. The electroacoustic transducer includes a plurality of sound paths for guiding the sound generated by the diaphragm 13 to the rear surface of the baffle 21.

10 Claims, 7 Drawing Sheets

ELECTROACOUSTIC TRANSDUCER

TECHNICAL FIELD

The present invention relates to an electroacoustic transducer.

BACKGROUND ART

Electroacoustic transducers, such as a headphone set and a speaker, are known to convert electric signals into sound. Such an electroacoustic transducer includes a baffle holding a diaphragm. The baffle has a through hole extending in the thickness direction (hereinafter also referred to as rearward direction) of the baffle to release sound emitted from the diaphragm in the rearward direction, and thus preventing distortion of the diaphragm. Such an electroacoustic transducer generates reduced acoustic resistance components in the sound emitting direction or frontward direction of the diaphragm to achieve stable operation of the diaphragm.

The electroacoustic transducer also includes an acoustic resistor disposed over the through hole of the baffle and having frequency-dependent attenuation characteristics. The acoustic resistor generates a resistance while sound is passing through the through hole, thus improving the operation of the diaphragm in response to a specific frequency. The electroacoustic transducer having such a design achieves a smooth frequency response of a driver unit including a driver and a diaphragm.

Unfortunately, the electroacoustic transducer having such a structure has a difficulty in achieving a smooth frequency response over a wide bandwidth to a variety of sound levels having different wavelengths.

Japanese Unexamined Patent Application Publication No. 2011-087993 (Patent Literature 1), for example, discloses a headphone set including a first hole to release air inside a rear air chamber to the external space and a second hole to release air inside a front air chamber to the external space.

The headphone set disclosed in Patent Literature 1 also has a difficulty in achieving a smooth frequency response over a wide bandwidth.

SUMMARY OF INVENTION

Technical Problem

An object of the invention is to provide an electroacoustic transducer that can achieve a smooth frequency response over a wide bandwidth.

Solution to Problem

An electroacoustic transducer according to the invention includes a driver, a diaphragm driven to vibrate by the driver and emitting sound, a baffle holding the diaphragm, apertures extending from the front surface to the rear surface of the baffle, and an acoustic resistor disposed on the front surface of the baffle so as to cover the apertures. The electroacoustic transducer has a plurality of sound paths allowing the sound generated by the diaphragm to pass to the rear surface of the baffle.

DESCRIPTION OF EMBODIMENTS

A first embodiment of an electroacoustic transducer according to the invention will now be described with reference to the attached drawings.

Headphone Set (1)

Figure 1:
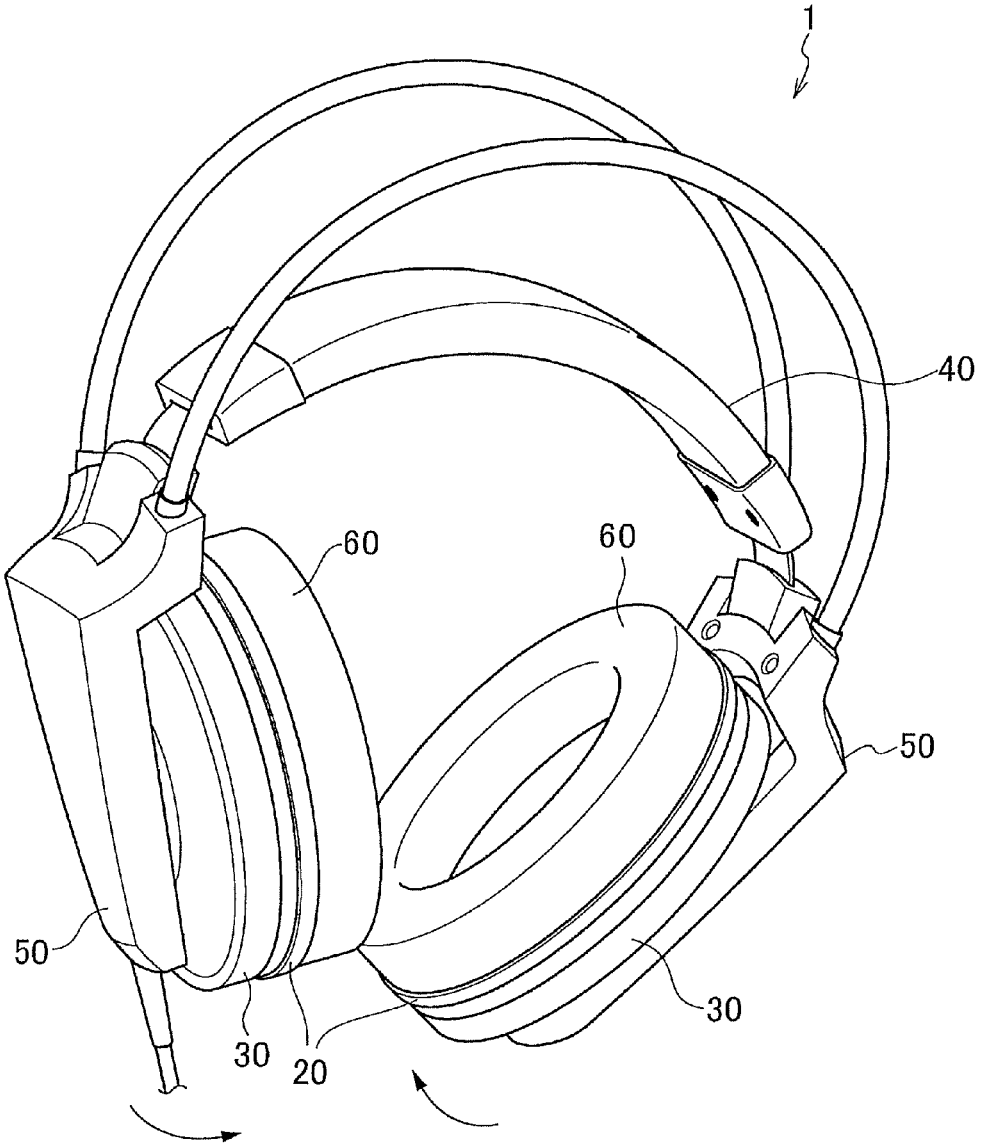
FIG. 1 is a perspective view of a headphone set according to a first embodiment of an electroacoustic transducer of the invention.
Figure 2:
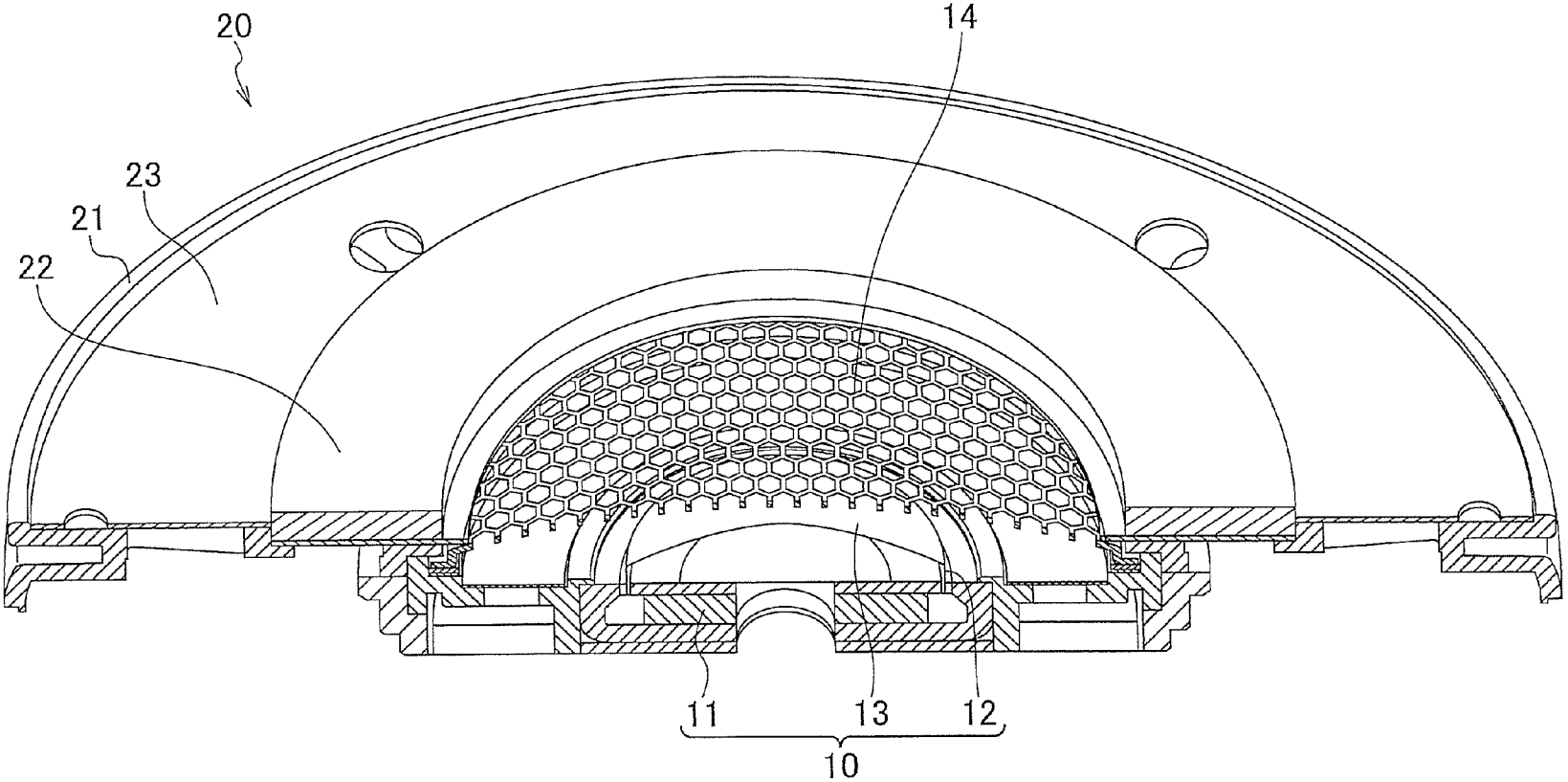
FIG. 2 is a perspective view of a baffle assembly in the headphone set of FIG. 1.

FIG. 1 illustrates a headphone set 1 according to a first embodiment of an electroacoustic transducer of the invention. With reference to FIG. 2, the headphone set 1 includes driver units 10 driven in response to electric signals and emitting sound and baffle assemblies 20 mounting the respective driver units 10. With reference to FIG. 1, the headphone set 1 also includes housings 30 coupled with the respective baffle assemblies 20 to form headphone units and a headband 40 to hold the headphone units onto the head of the user. The headphone set 1 further includes supports 50 connected with the headband 40 and holding the respective housings 30 and ear pads 60 to come into contact with the ear regions of the user. Each headphone units has a substantially elliptic cylinder shape so as to cover the ear region of the user.

FIG. 2 is a perspective view of the baffle assembly 20 viewed from the sound emitting side of the driver unit 10. In the following description, the sound emitting side of the driver unit 10 is also referred to as a front surface of the baffle assembly 20 or a baffle 21, while the surface opposite to the front surface is referred to as a rear surface thereof. As illustrated in FIG. 2, the baffle assembly 20 includes the driver unit 10, a first acoustic filter 22, a second acoustic filter 23 on the front surface of the baffle 21 holding the driver unit 10 including a diaphragm 13, and other components.

The driver unit 10 mounted on the baffle assembly 20 includes a driver. The driver includes a magnet 11 generating a magnetic field and a voice coil 12 disposed in the magnetic field generated by the magnet 11 and driven in response to electric signals. The voice coil 12 is mounted on the diaphragm 13 of the driver unit 10. Vibration of the diaphragm 13 coupled with the voice coil 12 emits sound. The front surface of the driver unit 10 is provided with a protector 14 protecting the diaphragm 13 and other components and having multiple holes allowing sound to pass therethrough.

Figure 3:
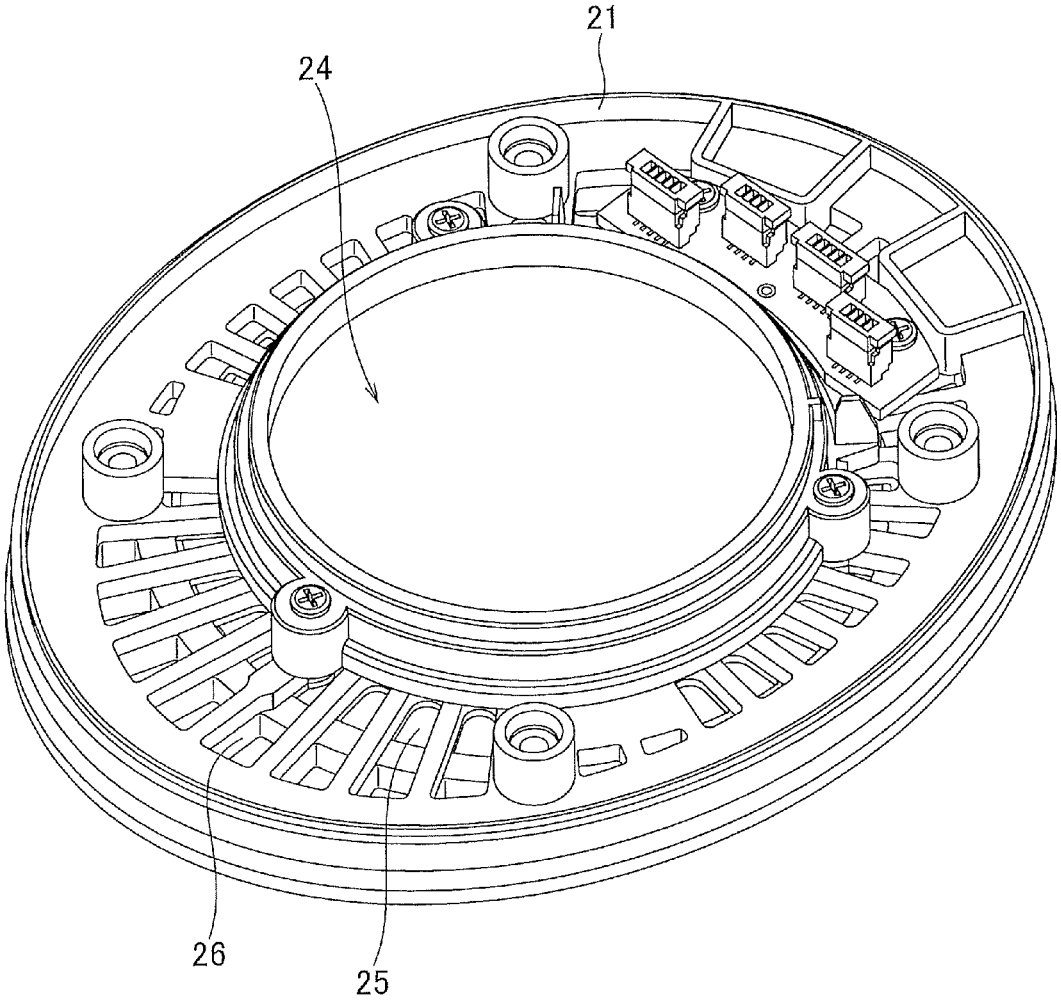
FIG. 3 is a perspective view illustrating a baffle in the baffle assembly of FIG. 2.

FIG. 3 is a perspective view of the baffle 21 viewed from its rear surface. The baffle 21 is a substantially elliptic plate conforming to the shape of the headphone unit which is a substantially elliptic cylinder. The baffle 21 includes a driver unit receiving portion 24, which is a substantially circular opening to receive the driver unit 10. The baffle 21 includes multiple first apertures 25 disposed radially outward from the driver unit receiving portion 24. Each of the first apertures 25 extends from the front surface to the rear surface of the baffle 21. The baffle 21 also includes multiple second apertures 26 disposed radially outward from the respective first apertures 25 of the baffle 21. The second apertures 26 each extend from the front surface to the rear surface of the baffle 21.

The first apertures 25, which are disposed radially outward from the driver unit receiving portion 24 of the baffle 21, are rectangular slits, for example. The second apertures 26, which are disposed radially outward from the respective first apertures 25 of the baffle 21, are rectangular slits, for example. The first apertures 25 and the second apertures 26 are radially disposed about the center of the baffle 21. The first apertures 25 and the second apertures 26 of the invention may have any other shape extending from the front surface to the rear surface of the baffle 21.

Figure 4A:
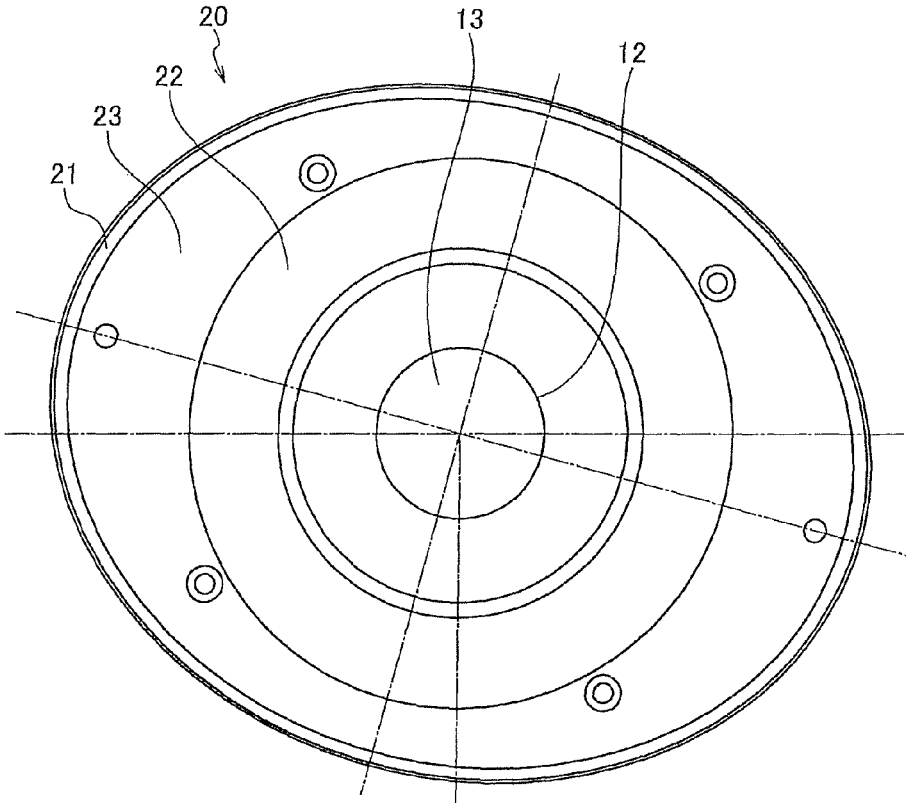
FIG. 4A is a front view of the baffle assembly of FIG. 2.
Figure 4B:
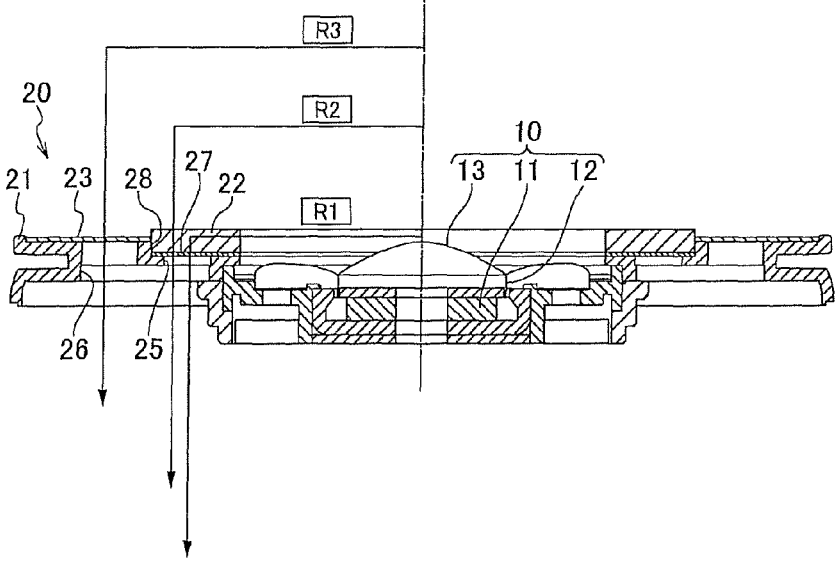
FIG. 4B is a sectional view of the baffle assembly of FIG. 2.

With reference to FIG. 4A and FIG. 4B, the first acoustic filter 22 is disposed so as to cover the first apertures 25. The first acoustic filter 22 serves as a first acoustic resistor that attenuates sound emitted from the diaphragm 13 and passing through the first apertures 25. The second acoustic filter 23 is disposed so as to cover the second apertures 26. The second acoustic filter 23 serves as a second acoustic resistor that attenuates sound emitted from the diaphragm 13 and passing through the second apertures 26. A third acoustic filter 27, which serves as a third acoustic resistor, is disposed on the rear surface of the baffle 21 so as to cover the first apertures 25. In other words, the third acoustic filter 27 is disposed between the baffle 21 and the first acoustic filter 22. The first acoustic filter 22, the second acoustic filter 23, and the third acoustic filter 27 are each formed of a material, such as felt, having a predetermined air permeability or acoustic resistance to attenuate sound passing therethrough.

The first acoustic filter 22 and the second acoustic filter 23 each may have a predetermined acoustic resistance to achieve essential attenuation characteristics. In the first embodiment, the first acoustic filter 22 is formed of a felt having a higher density than that of the second acoustic filter 23, so that the acoustic resistance of the first acoustic filter 22 is greater than that of the second acoustic filter 23.

The baffle 21 has a step 28 disposed radially outward from the first acoustic filter 22 of the baffle 21. The first acoustic filter 22 is positioned by the step 28 and is disposed inward from the step 28 (i.e., adjacent to the driver unit 10). The second acoustic filter 23 surrounds the periphery of the first acoustic filter 22.

The headphone unit includes a plurality of sound paths for guiding the sound generated by the diaphragm 13 to a rear air chamber adjacent to the rear surface of the baffle 21. The sound paths includes a first sound path R1 extending from a side wall of the first acoustic filter 22 to the first aperture 25, a second sound path R2 extending from the front surface of the first acoustic filter 22 to the first aperture 25, and a third sound path R3 extending the front surface of the second acoustic filter 23 to the second aperture 26.

The headphone unit includes an ear pad 60 attached on the sound emitting side. An elevated air pressure in a front air chamber in the ear pad 60 generated by the vibration of the diaphragm 13 may push back the diaphragm 13. This may distort the diaphragm 13, generating muddy sound. To solve this problem, the headphone unit, which includes the baffle 21 having the first apertures 25 and the second apertures 26 for guiding sound from the front surface to the rear surface of the baffle 21, prevents a change in air pressure in the front air chamber to reduce the distortion of the diaphragm 13. An essential distance between the vibration node of the diaphragm 13 and the front air chamber depends on sound bands; accordingly, the sound paths for guiding sound from the front air chamber should preferably have different lengths. This design allows the headphone unit to yield a smooth frequency response over a wide sound bandwidth.

Figure 5:
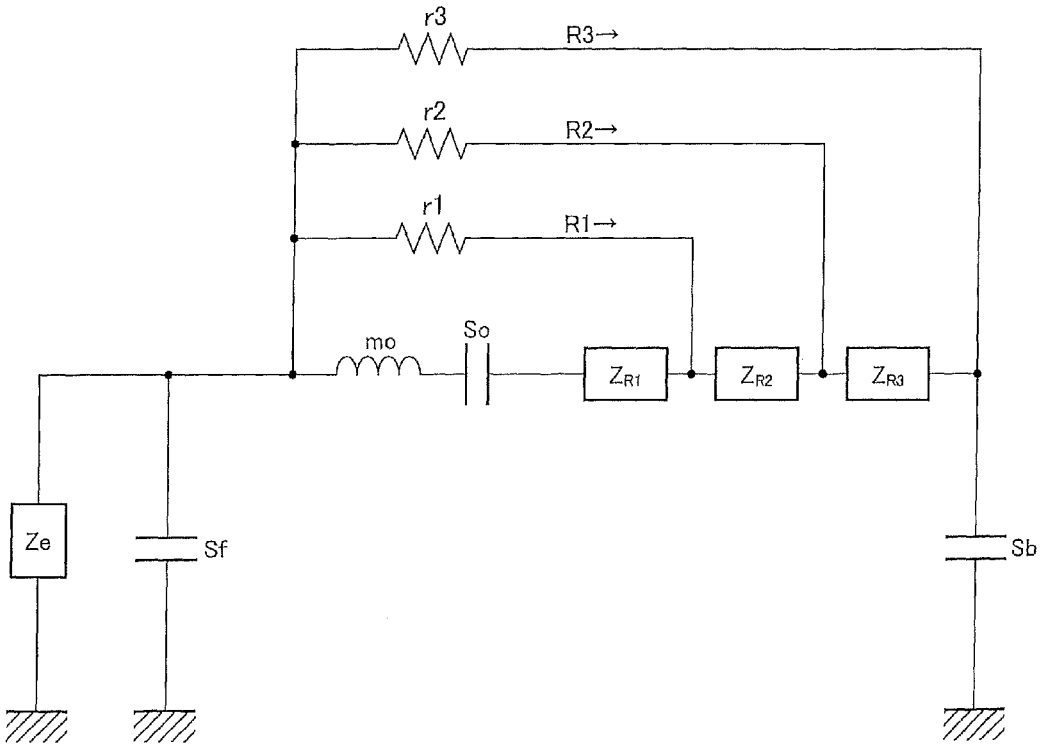
FIG. 5 is an acoustic equivalent circuit diagram of the headphone set of FIG. 1.

The acoustic equivalent circuit diagram of the headphone unit shown in FIG. 5 uses the same reference numerals as those in the sectional view of the baffle assembly 20 in FIG. 4B. In the acoustic equivalent circuit diagram of FIG. 5, symbol Ze represents the impedance of an ear of the user, symbol sf represents the stiffness of the volume in the front air chamber in the ear pad 60, symbol sb represents the stiffness of the volume in the rear air chamber of the baffle 21 adjacent to the rear surface, symbol mo represents the mass of the diaphragm 13, symbol so represents the stiffness of the diaphragm 13, symbol r1 represents the acoustic resistance of the first sound path R1, symbol r2 represents the acoustic resistance of the second sound path R2, symbol r3 represents the acoustic resistance of the third sound path R3, symbol Za1 represents the radiation impedance from the first sound path R1 to the rear air chamber, symbol Za2 represents the radiation impedance from the second sound path R2 to the rear air chamber, and symbol Za3 represents the radiation impedance from the third sound path R3 to the rear air chamber.

With reference to FIG. 5, the headphone unit includes sound paths; the first sound path R1, the second sound path R2, and the third sound path R3, that guide the sound generated by the diaphragm 13 to the rear air chamber. The sound paths respectively have the acoustic resistances r1, r2 and r3 depending on the properties (i.e., thickness and area) of the first acoustic filter 22 and the second acoustic filter 23. The first, second, and third acoustic filters 22, 23, 27 generate the acoustic resistances r1, r3 and r2, respectively in the headphone unit.

As mentioned above, the headphone unit is designed to direct the sound generated by the diaphragm 13 to the rear air chamber through a plurality of sound paths having different lengths thereby achieving an improved frequency response of these sound paths having different sound bands. This design allows the headphone set 1 to yield a smooth frequency response over a wide sound bandwidth.

The headphone set 1, which includes a plurality of sound paths for guiding the sound generated by the diaphragm 13 to the rear air chamber, can upgrade the resolution of sound. The headphone set 1 can improve the transient characteristic in a sound rise interval, especially when the headphone set 1 employs a fully digital sound system outputting rectangular wave signals.

The headphone set 1, which includes the acoustic resistors in the respective sound paths R1, R2, and R3, reduces acoustic resistance components to be generated in the sound emitting side of the diaphragm to achieve stable operation of the diaphragm. The acoustic filters 22, 23, 27 having different acoustic resistances (permeability) provide improved frequency response in their sound bands.

The headphone set 1, which includes the baffle 21 having the step 28 defining the second sound path R2, can provide a smooth frequency response.

As mentioned above, the headphone set 1 of the first embodiment can provide a smooth frequency response over a wide bandwidth.

Headphone Set (2)

A second embodiment of an electroacoustic transducer according to the invention will now be described focusing on the differences from the first embodiment.

Figure 6:
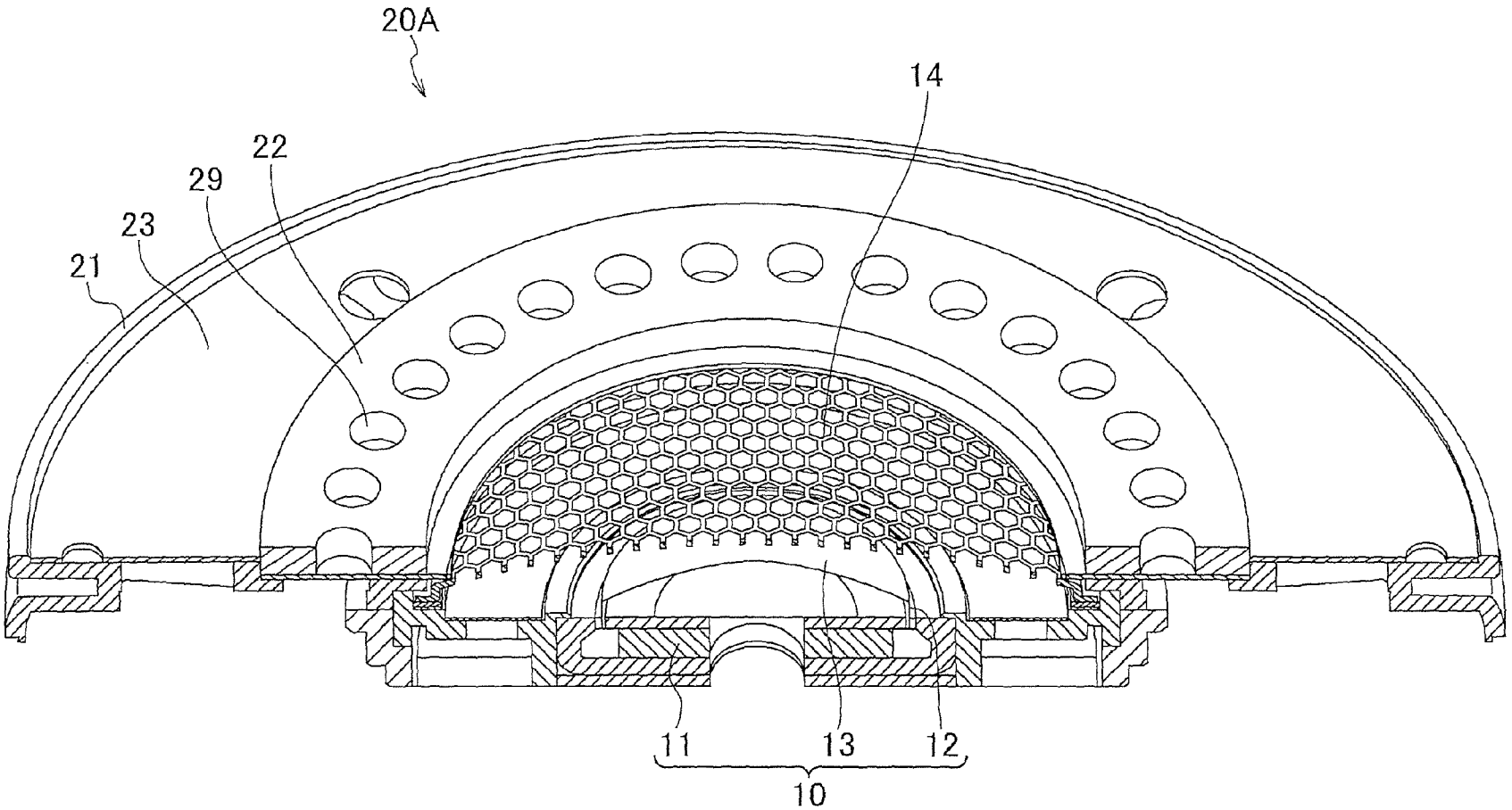
FIG. 6 is a perspective sectional view of a baffle assembly in a headphone set according to a second embodiment of an electroacoustic transducer according to the invention.

FIG. 6 is a perspective sectional view of the baffle assembly 20A of the headphone set 1 according to the second embodiment. The baffle assembly 20A is different from the baffle assembly 20 of the first embodiment in that the baffle assembly 20A has third apertures 29 each extending from the front surface to the rear surface of the first acoustic filter 22.

Figure 7A:
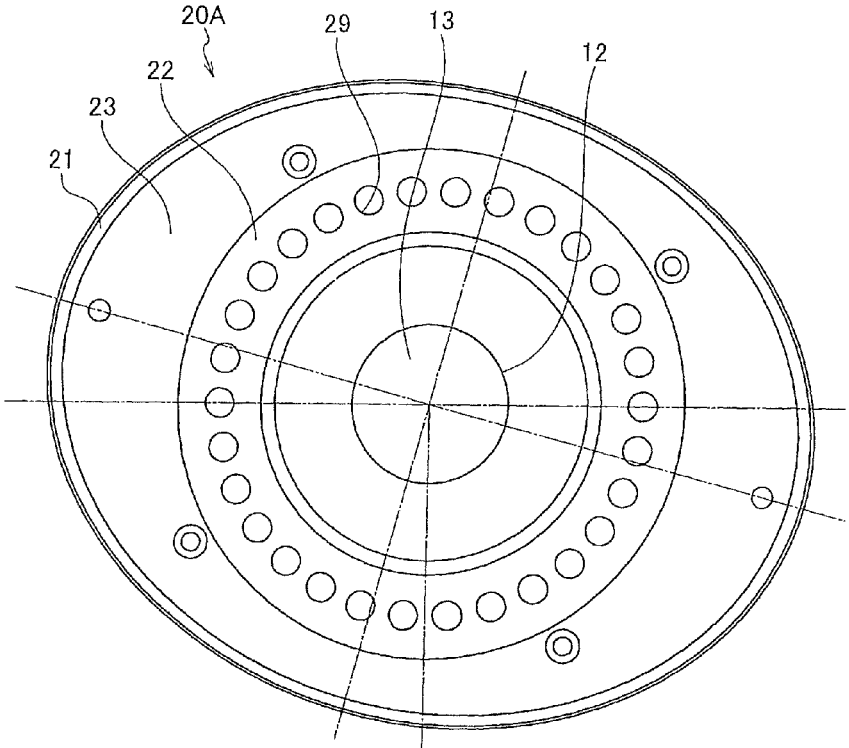
FIG. 7A is a front view of the baffle assembly of FIG. 6.
Figure 7B:
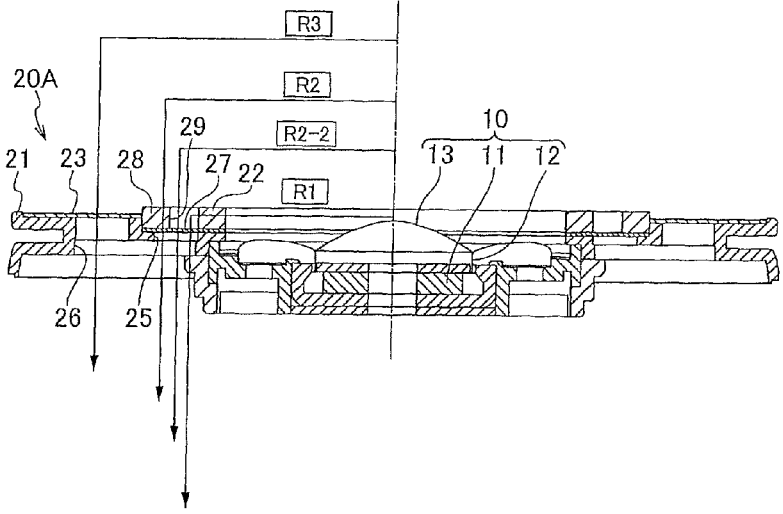
FIG. 7B is a sectional view of the baffle assembly of FIG. 6.

With reference to FIG. 7A and FIG. 7B, each of the third apertures 29 in the first acoustic filter 22 defines a fourth sound path R2-2 for guiding the sound generated by the diaphragm 13 to the rear air chamber adjacent to the rear surface of the baffle 21. The fourth sound path R2-2 extends from the front surface of the first acoustic filter 22 to the first aperture 25 through the third aperture 29.

The headphone set 1 including the third apertures 29 described above may be used as a headphone of an open-type that can provide a smooth flow of sound to the rear air chamber, rather than a closed-type described above. The headphone set 1 including the third apertures 29 allows the sound generated by the diaphragm 13 to pass to the rear air chamber adjacent to the rear surface of the baffle 21 through increased number of sound paths. The headphone set 1 can therefore provide improved frequency responses over a wide bandwidth.

The driver units 10 of the embodiments described above each have a driver of a dynamic-type including a magnet 11 and a voice coil 12 for driving the diaphragm 13. Alternatively, the drivers included in the electroacoustic transducer of the invention may be of a capacitor-type.

While the foregoing embodiments of the invention are headphone sets, the invention should not be limited thereto but is applicable to a speaker or any other electroacoustic transducer.

The invention claimed is:

1. An electroacoustic transducer comprising:

a driver;

a diaphragm driven to vibrate by the driver and emitting sound;

a baffle holding the diaphragm;

first apertures extending from a front surface to a rear surface of the baffle; and a first acoustic resistor disposed on the front surface of the baffle so as to cover the first apertures, wherein the electroacoustic transducer comprises a plurality of sound paths for guiding sound generated by the diaphragm to the rear surface of the baffle.

2. The electroacoustic transducer according to claim 1, wherein the plurality of sound paths comprise at least a first sound path extending from the diaphragm to the corresponding first aperture and a second sound path extending from the diaphragm to the corresponding first aperture through the first acoustic resistor.

3. The electroacoustic transducer according to claim 2, further comprising second apertures disposed radially outward from the respective first apertures of the baffle, wherein the plurality of sound paths further comprise a third sound path extending from the diaphragm to the corresponding second aperture.

4. The electroacoustic transducer according to claim 3, further comprising a second acoustic resistor disposed over the second apertures of the baffle.

5. The electroacoustic transducer according to claim 4, wherein the second acoustic resistor is different in acoustic resistance from the first acoustic resistor.

6. The electroacoustic transducer according to claim 1, wherein the baffle has a step, and the first acoustic resistor is disposed radially inward of the step of the baffle.

7. The electroacoustic transducer according to claim 1, further comprising third apertures extending from a front surface to a rear surface of the first acoustic resistor.

8. The electroacoustic transducer according to claim 1, wherein the driver comprises:

a magnet generating a magnetic field; and a voice coil disposed in the magnetic field and driven in response to electric signals.

9. The electroacoustic transducer according to claim 1, further comprising a third acoustic resistor disposed over the first apertures and sandwiched by the baffle and the first acoustic resistor.

10. The electroacoustic transducer according to claim 4, further comprising a third acoustic resistor disposed over the first apertures and sandwiched by the baffle and the first acoustic resistor, wherein the first, second, and third acoustic resistors have different acoustic resistances.

* * * * *